US005595477A

United States Patent [19]

Amlinger

[11] Patent Number: 5,595,477

[45] Date of Patent: Jan. 21, 1997

[54] VACUUM PUMPING STAND

[75] Inventor: Heinrich Amlinger, Niddatal, Germany

[73] Assignee: SGI-Prozesstechnik GmbH, Altenstadt, Germany

[21] Appl. No.: 590,053

[22] Filed: Jan. 16, 1996

[30] Foreign Application Priority Data

Jan. 13, 1995 [DE] Germany ..... 195 00 823.5

[51] Int. Cl.[6] ..... F04C 23/00; F04C 25/02; F04C 41/06; F04C 25/16

[52] U.S. Cl. ..... 417/69; 417/203; 417/205; 417/251

[58] Field of Search ..... 417/69, 203, 205, 417/251, 252

[56] References Cited

U.S. PATENT DOCUMENTS

| | | | |
|---|---|---|---|
| 1,711,902 | 5/1929 | Neumann | 417/69 |
| 3,642,384 | 2/1972 | Huse | 417/205 |
| 3,922,110 | 11/1975 | Huse | 417/69 X |
| 4,225,288 | 9/1980 | Mugele et al. | 417/69 X |
| 4,505,647 | 3/1985 | Alloce et al. | 417/252 |
| 4,699,570 | 10/1987 | Bohn . | |
| 4,850,806 | 7/1989 | Morgan et al. . | |
| 5,244,352 | 9/1993 | Mugele | 417/69 |

FOREIGN PATENT DOCUMENTS

| | | |
|---|---|---|
| 0541989A1 | 5/1993 | European Pat. Off. . |
| 2462187A1 | 9/1976 | Germany . |

*Primary Examiner*—Richard E. Gluck
*Attorney, Agent, or Firm*—Evenson, McKeown, Edwards & Lenahan, P.L.L.C.

[57] ABSTRACT

A vacuum pumping stand for the cyclic pumping-down of containers and for maintaining an operating vacuum in the containers, for the pumping-down of the container. The vacuum pumping stand has a first and a second vacuum pump which are arranged in series and form a first and a second pumping stage. The first vacuum pump is a radial flow compressor with a controllable throttle which is located in the intake pipe to the first vacuum pump. The second vacuum pump is a rotary compressor or a water ring pump. The second vacuum pump is located in a vacuum pipe in parallel to an outlet pipe of the first vacuum pump and is connected with its inlet at a branch-off with the outlet pipe. A control part is situated in each of the outlet pipe and the vacuum pipe downstream of the branch-off for directing the delivered volume at higher pressures from the first vacuum pump directly or at lower pressures from the first vacuum pump by way of the second vacuum pump 13 to the outlet 10 of the vacuum pump stand.

6 Claims, 1 Drawing Sheet

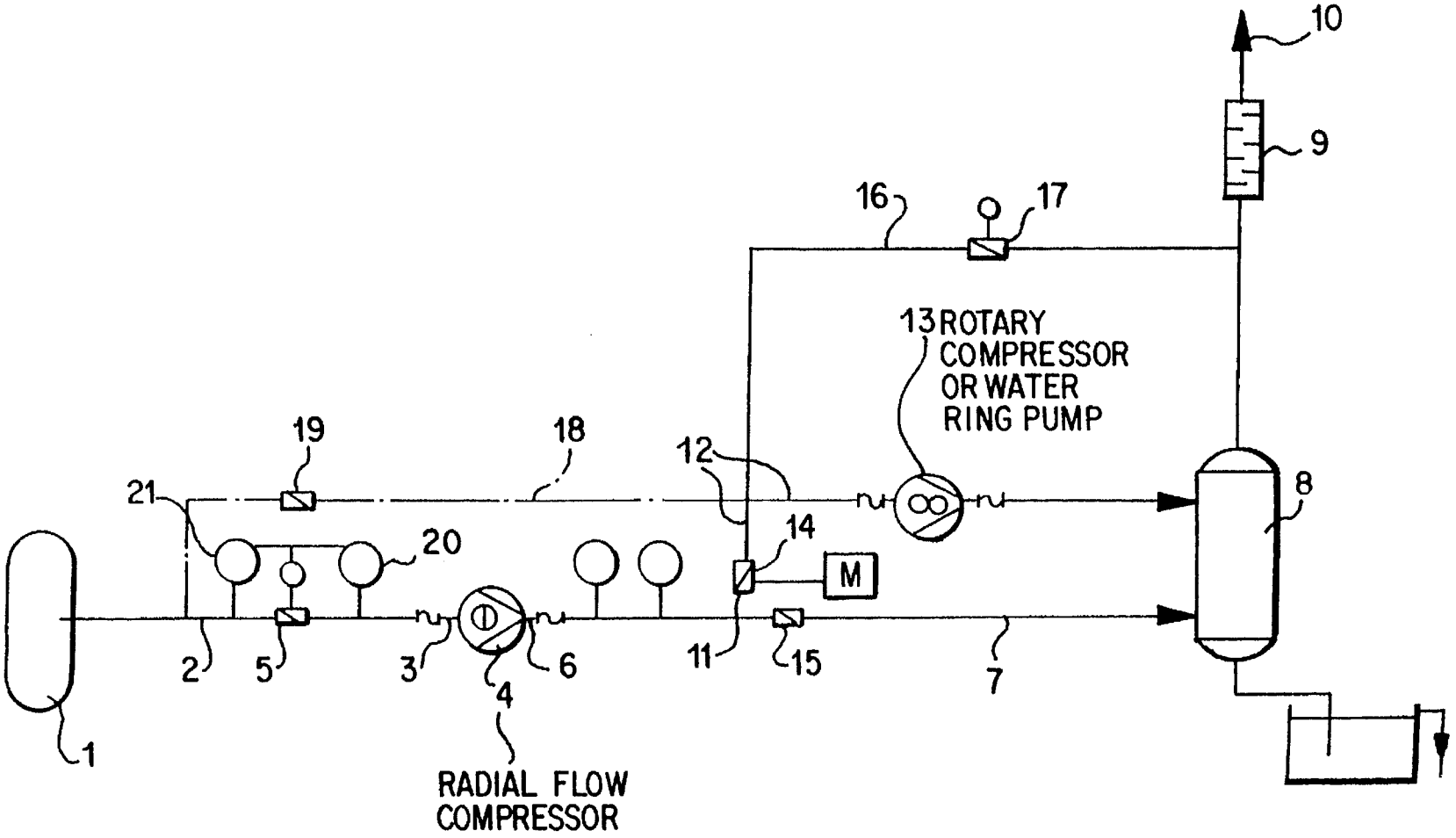
10
9
8
17
16
13 ROTARY COMPRESSOR OR WATER RING PUMP
7
M
14
15
12
11
18
6
4
RADIAL FLOW COMPRESSOR
3
20
19
5
2
21
1

VACUUM PUMPING STAND

BACKGROUND OF THE INVENTION

This invention relates to a vacuum pumping stand for the cyclic pumping-down of a container and for maintaining an operating vacuum in the container. More specifically, this invention relates to a vacuum pumping stand for the cyclic pumping-down of a container and for maintaining an operating vacuum in the container, which has a first and a second vacuum pump which are arranged in series and form a first and a second pumping stage.

In the art, pumping stands of the above-mentioned type are used, for example, for the cyclic pumping-down of adsorbers in order to carry out the regeneration of zeolites or other adsorption agents in a vacuum in the case of vacuum swing systems or pressure-vacuum swing systems for oxygen and nitrogen enrichment. In the case of such systems, it is important that large amounts of gas are sucked relatively rapidly out of an adsorber and subsequently an operating vacuum is maintained in it. Currently, this takes place in pumping stands which are constructed of rotary compressors operating in several stages. Although such pumping stands are satisfactory with respect to their function, technical experts are trying to further reduce their energy requirement because this energy requirement plays an important role in cyclic processes. However, recently only little progress has been made with respect to a reduction of the energy requirement in the case of pumping stands constructed of rotary compressors.

SUMMARY OF THE INVENTION

The primary object of the invention is to develop a vacuum pumping stand of the aforementioned type, which is constructed as simply as possible and can be manufactured at reasonable cost, in such a manner that its energy requirement is as low as possible.

According to the invention, this object is achieved by using a radial flow compressor with a controllable throttle switched into its intake pipe as the first vacuum pump and a rotary compressor or a water ring pump as the second vacuum pump. Switching the second vacuum pump into a vacuum pipe in parallel to an outlet pipe of the first vacuum pump and, with its inlet at a branch-off, the second vacuum pump is connected with the outlet pipe of the first vacuum pump. A control part is arranged at the downstream side of each of said vacuum pipe and said outlet pipe for directing the displaced volume at higher pressures from the first vacuum pump directly or at lower pressures from the first vacuum pump by way of the second vacuum pump to the outlet of the vacuum pumping stand.

Up to now, the use of a radial flow compressor as the first vacuum pump had been rejected by the technical experts in cases in which the intake conditions for the radial flow compressor fluctuate severely. For example, in the case of vacuum swing systems, adsorbers must be cyclically evacuated from an absolute pressure of in each case approximately 1,000 mbar to approximately 300 mbar. In the case of an intake condition of 1,000 mbar, the power consumption of radial flow compressors is higher than when the intake condition is 600 mbar by a factor of 3.9. Starting at 600 mbar to approximately 100 mbar, the suction capacity of radial flow compressors is almost constant while the maximum pressure condition is utilized; however, the power consumption is lower by the value of the differential pressure-dependent, volumetric losses in the case of comparable rotary compressors. Because of their high rotational speed of approximately 11,000 $min^{-1}$ and more, radial flow compressors hardly have any gas backflow and therefore a volumetric efficiency of almost 1. While the suction capacity of a radial flow compressor is the same as that of a rotary compressor in the case of a comparable differential pressure between the inlet and the outlet, the power consumption is clearly lower in radial flow compressors. This means that, in the case of a pressure on the intake side of 600 mbar, 18% less power consumption is achieved and, in the case of an intake pressure of 300 mbar, 23% less power consumption is achieved, while the maximal compression ratio in the case of these operating conditions is utilized.

According to the invention, a saving of energy is achieved because, by means of the controllable throttle, the suction capacity of the radial flow compressor in the case of a maximal pressure ratio is held to be constant in every intake condition. This throttling between an atmospheric pressure of 1,000 mbar to 600 mbar until an absolute pressure of 600 mbar is reached on the suction side as a result of the sucking-off, naturally causes a relatively high power loss in comparison to a rotary compressor in which such a throttling is unnecessary. However, surprisingly, for the cyclic operation, during which the suction must take place relatively rapidly in a successive manner from the normal pressure to an operating vacuum, it could be determined that, as a result of the particularly economical operation which is achieved because of the combination of a radial flow compressor and a rotary compressor in the case of suction pressures of less than 600 mbar, this initially higher energy requirement is more then compensated so that, on the whole, energy is saved with the arrangement according to the invention. The reason is that the pipework makes it possible to evacuate the pump train with the radial flow compressor during the starting of the pumping stand with the rotary compressor.

According to the invention, the second pumping stage or additional pumping stages are therefore constructed as rotary compressors because, as a comparison, a radial flow compressor constructed as the second stage would have to operate with an intake pressure of between 1,000 mbar and 600 mbar and would therefore always be in an operating range for radial flow compressors which is unfavorable with respect to energy.

In the case of the pumping stand according to the invention, it is also advantageous that, by means of the currently commercially available vacuum pumps, maximal suction outputs of above 90,000 $m^3/h$ can be achieved and that the manufacturing costs are lower than those for comparable pumping stands.

If the first and the second vacuum pump are switched such that they operate only successively and not in parallel, the control of the volume flows can necessarily take place without the requirement of activating the control parts by means of a motor so that the laying of control pipes becomes unnecessary if, according to a further preferred embodiment of the invention, the control part in the outlet pipe is constructed as a check valve opening up in the direction of the outlet of the vacuum pumping stand and the control part in the vacuum pipe is constructed as a check valve opening up in the direction of the inlet of the second pumping stage.

The controllable throttle connected in front of the first vacuum pump may be a conventional swirl control device. However, the throttle can, at the same time, block off the pipe in which it is arranged so that, during the start of the operation, an evacuation of the pump train with the radial flow compressor becomes possible without the arrangement of an additional shut-off element if, according to a further embodiment of the invention, the controllable throttle connected in front of the first vacuum pump is a flap valve which can be activated by a motor and can be moved into the closing position. Such a flap valve makes it possible to rapidly change large cross-sections so that a low-inertia control is permitted.

During the start of the operation and during no-load phases, the rotary compressor forming the second pumping stage can continue to run with particularly low losses if the second vacuum pump has a bypass with a motor-driven shut-off valve which connects its outlet side and its inlet side.

When, at the beginning of the sucking-off, a normal pressure exists in the container to be sucked-off, it is advantageous for both vacuum pumps to be able to operate in parallel to one another at the starting of the pumping-down because then the required gas volume can be sucked off as rapidly as possible. This can be achieved in a simple manner in that, from the vacuum pipe, which connects the outlet of the first vacuum pump with the inlet of the second vacuum pump, a suction pipe to the intake pipe of the first vacuum pump leads to in front of the throttle and the control part is controlled by a motor.

BRIEF DESCRIPTION OF THE DRAWING

The invention allows numerous embodiments. Other objects, advantages and applications of this invention will be made apparent by the following detailed description. The description makes reference to a preferred and illustrative embodiment of the invention presented in the accompanying drawings wherein:

One of the embodiments is diagrammatically illustrated in the drawing. This drawing shows a connection diagram of a pumping stand according to the invention.

DESCRIPTION OF THE PREFERRED EMBODIMENT

The drawing schematically illustrates a container 1 which is to be pumped empty and from which an intake pipe 2 leads to an inlet 3 of a first vacuum pump 4. According to the invention, this first vacuum pump 4 is constructed as a radial flow compressor (turbo compressor). In order to permit this compressor to operate economically at intake pressures of between 600 mbar and 1,000 mbar in the container 1, a controllable throttle 5 is connected in the intake pipe 2.

By means of two pressure sensors 20 and 21 and in a manner which is not shown but which is conventional for a person skilled in the art, this throttle 5 is controlled such that an intake pressure of no more than 600 mbar always exists at the inlet 3 of the first vacuum pump 4 as long as the pressure in the container 1 is higher. The intake pressure of the first vacuum pump should be no more than 600 mbar. If the intake pressure increases, the throttle 5 must close and if the intake pressure decreases, the throttle 5 must open. This could be controlled by means of the pressure sensor 20 and a controller. In this case, the second pressure sensor 21 is not required. The preferred embodiment, however, uses two pressure sensors 20 and 21 in order to sense the pressure difference. If the difference is 0 or nearly 0, the throttle 5 opens and if the pressure difference is higher than a predetermined value, the throttle 5 moves into a nearly closed position. By using two sensors, 20 and 21, a stepless control with intermediate positions is not necessary. The throttle 5 can always either open or nearly close. This is less costly than using a stepless controller. In addition, the pressure may be controlled faster.

The first vacuum pump 4 has an outlet 6 from which an outlet pipe 7 leads to a pulsation damper 8 and therefore, by way of a sound absorber 9, leads to an outlet 10 of the vacuum pumping stand.

At a branch-off 11, the outlet pipe 7 is connected with a vacuum pipe 12 which extends in parallel to it, which also leads into the pulsation damper 8 and is switched into a second vacuum pump 13. This second vacuum pump 13, which forms the second pumping stage, according to the invention, is a rotary compressor (Roots pump) or a water ring pump.

Viewed from the outlet 6 of the first vacuum pump 4, one control part 14 or 15, respectively, in the form of a check valve is arranged behind the branch-off 11 in each of the outlet pipe 7 and the vacuum pipe 12. The check valve of the control part 14 opens in the direction of the second vacuum pump 13 and the check valve of the control part 15 opens in the direction of the pulsation damper 8.

A bypass 16 having a shut-off valve 17 is assigned to the second vacuum pump 13. This bypass 16 permits the connection of the outlet of the second vacuum pump 13 with the vacuum pipe 12 and therefore makes it possible that the second vacuum pump 13 is short-circuited and can therefore operate with a low energy requirement in the no-load operation under atmospheric pressure. During the start of the operation by means of the second vacuum pump 13, while the throttle 5 is closed, the vacuum pipe 12 makes it possible to evacuate the first vacuum pump 4 and the corresponding pipes. As a result, in the no-load operation, the vacuum pump 4 constructed as a radial compressor can operate without suction capacity and differential pressure in the vacuum with the most minimal power consumption. If, via the vacuum pipe 12, the first vacuum pump 4 and the corresponding pipes have been evacuated by the second vacuum pump 13, one can open shut-off valve 17. Due to this, the control part (check valve) 15 remains closed and the control part (check valve) 14 and the check valve 19 close due to the air pressure. Due to the bypass 16, the second vacuum pump 13 has atmospheric pressure at the inlet and at the outlet if the shut-off valve 17 is open.

From the vacuum pipe 12, a suction pipe 18, which is illustrated by a dash-dotted line, may lead to the intake pipe 2 in front of the throttle 5. A check valve 19 is connected into this suction pipe 18 and opens up in the direction of the second vacuum pump 13. Such a suction pipe 18 permits a parallel operation of the first and second vacuum pumps 4 and 13 which is advantageous when, at the start of the suction phase, a large volume must be sucked off from the container 1, particularly if normal pressure will then exist in it. It is a prerequisite for such a parallel operation that the control part 14 can be operated by means such as a motor so that it does not open by itself as a result of the vacuum generated by the second vacuum pump 13 because then the second vacuum pump 13 would take in on both sides of the first vacuum pump 4.

If, already at the start of the sucking-off of the container 1, a relatively low pressure exists in this container 1, such as 700 mbar, this suction pipe 18 can be omitted for the purpose of simplifying the pumping stand.

At the start of the sucking-off of the container 1, the first vacuum pump 4 and the second vacuum pump 13 operate in parallel with respect to one another so that, by way of the intake pipe 2 and the suction pipe 18, gas is transported by way of the pulsation damper 8 to the outlet 10. When the gas quantity delivered by the first vacuum pump 4 becomes smaller than the volume which can be delivered by the second vacuum pump 13, the second vacuum pump 13 will suck off by way of the vacuum pipe 12 the volume flow occurring at the outlet 6 of the first vacuum pump 13.

It should be apparent from the foregoing detailed description that the objects set forth at the outset to the specification have been successfully achieved. Moreover, while there is shown and described present preferred embodiments of the invention, it is to be distinctly understood that the invention is not limited thereto but may be otherwise variously embodied and practiced within the scope of the following claims.

What is claimed is:

1. Vacuum pumping stand for the cyclic pumping-down of a container and for maintaining an operating vacuum in the container, comprising:

(A) a first and a second vacuum pump normally arranged in series and forming a first and a second pumping stage, respectively, wherein the first vacuum pump is a radial flow compressor having a first inlet and a first outlet and the second vacuum pump is one of a rotary compressor and a water ring pump, having a second inlet and a second outlet;

(B) an intake pipe leading to said first inlet;

(C) an outlet pipe leading from said first outlet;

(D) a controllable throttle located in the intake pipe;

(E) a vacuum pipe branching off said outlet pipe and thence in parallel to said outlet pipe, said vacuum pipe leading into said second inlet of said second vacuum pump;

(F) an outlet of said vacuum pumping stand; and (G) a control means arranged in each of said vacuum pipe and said outlet pipe downstream of the branch-off for directing displaced volume from said container:

(1) from the first vacuum pump directly at higher pressures to the outlet of the vacuum pumping stand, and (2) from the first vacuum pump by way of the second vacuum pump at lower pressures to the outlet of the vacuum pumping stand.

2. Vacuum pumping stand according to claim 1, wherein the control means in the outlet pipe is a check valve opening up toward the outlet of the vacuum pumping stand, and the control means in the vacuum pipe is a check valve opening up toward the inlet of the second pumping stage.

3. Vacuum pumping stand according to claim 1, wherein the controllable throttle is a flap valve.

4. Vacuum pumping stand according to claim 2, wherein the controllable throttle is a flap valve.

5. Vacuum pumping stand according to claim 1, further comprising a bypass connecting the outlet side and inlet side of the second vacuum pump with one another and a shut-off valve in said bypass.

6. Vacuum pumping stand according to claim 1, further comprising a suction pipe from the vacuum pipe to the intake pipe in front of the throttle, and wherein the control means in the vacuum pipe is controlled by a motor.

* * * * *